US011102573B2

(12) United States Patent
Kim et al.

(10) Patent No.: US 11,102,573 B2
(45) Date of Patent: Aug. 24, 2021

(54) HIGH-WATER PRESSURE WATERPROOF MICROSPEAKER

(71) Applicant: EM-TECH Co., Ltd., Gyeongsangnam-do (KR)

(72) Inventors: Cheon Myeong Kim, Gyeongsangnam-do (KR); Sung Chul Jung, Gyeongsangnam-do (KR); Sung Jin Hong, Gyeonggi-do (KR)

(73) Assignee: EM-TECH CO., LTD., Gyeongsangnam-Do (KR)

( * ) Notice: Subject to any disclaimer, the term of this patent is extended or adjusted under 35 U.S.C. 154(b) by 0 days.

(21) Appl. No.: 16/731,675

(22) Filed: Dec. 31, 2019

(65) Prior Publication Data

US 2020/0221222 A1 Jul. 9, 2020

(30) Foreign Application Priority Data

Jan. 3, 2019 (KR) ..... 10-2019-0000851

(51) Int. Cl.

| | |
|---|---|
| ***H04R 1/44*** | (2006.01) |
| ***H01R 31/00*** | (2006.01) |
| ***H04R 9/06*** | (2006.01) |
| ***H04R 1/02*** | (2006.01) |
| ***H04R 7/04*** | (2006.01) |
| ***H04R 31/00*** | (2006.01) |

(52) U.S. Cl.

CPC ..... *H04R 1/44* (2013.01); *H04R 1/023* (2013.01); *H04R 7/04* (2013.01); *H04R 9/06* (2013.01); *H04R 31/003* (2013.01); *H04R 2307/00* (2013.01)

(58) Field of Classification Search

CPC ..... H04R 1/44; H04R 31/003; H04R 9/06; H04R 1/023; H04R 7/04; H04R 2307/00; H04R 1/026; H04R 7/22; H04R 2400/00; H04R 2499/11; H04R 2400/11; H04R 9/02

See application file for complete search history.

(56) References Cited

U.S. PATENT DOCUMENTS

| | | | | |
|---|---|---|---|---|
| 4,244,908 | A * | 1/1981 | Hirasuna | B29D 99/0053 264/236 |
| 9,027,700 | B2 * | 5/2015 | Kim | H04R 31/003 181/171 |
| 9,906,849 | B2 * | 2/2018 | Kato | G01H 15/00 |

(Continued)

FOREIGN PATENT DOCUMENTS

| | | |
|---|---|---|
| CN | 1735279 A | 2/2006 |
| CN | 2877180 Y | 3/2007 |

(Continued)

*Primary Examiner* — Oyesola C Ojo

(74) *Attorney, Agent, or Firm* — Murphy, Bilak & Homiller, PLLC

(57) ABSTRACT

A waterproof speaker having a waterproof rating of 8 or more and that is capable of providing a waterproof function at a high water pressure is provided. The waterproof micro-speaker includes: a frame comprising a sidewall and a flange portion extending outward from an upper edge of the sidewall; a vibrating portion within the frame; a diaphragm mounted on the flange portion of the frame; and a waterproof ring placed on a sidewall of the frame and configured to protrude further outward than the flange portion of the frame.

7 Claims, 1 Drawing Sheet

(56) References Cited

U.S. PATENT DOCUMENTS

| | | | | |
|---|---|---|---|---|
| 2003/0164262 | A1* | 9/2003 | Ito | H04R 9/06 181/171 |
| 2012/0257781 | A1* | 10/2012 | Kajihara | H04R 7/122 381/398 |
| 2016/0212526 | A1* | 7/2016 | Salvatti | H04R 1/026 |
| 2018/0152800 | A1* | 5/2018 | Cai | H04R 7/122 |

FOREIGN PATENT DOCUMENTS

| | | | | | |
|---|---|---|---|---|---|
| CN | 104125528 | A | | 10/2014 | |
| JP | 57020094 | | * | 2/1982 | H04R 31/00 |
| JP | 57020094 | | * | 7/1982 | H04R 31/00 |
| JP | S61182185 | A | | 8/1986 | |
| JP | H05268695 | A | | 10/1993 | |
| JP | H069188 | U | | 2/1994 | |
| KR | 20140128483 | A | | 11/2014 | |
| KR | 101889315 | B1 | | 8/2018 | |

* cited by examiner

HIGH-WATER PRESSURE WATERPROOF MICROSPEAKER

TECHNICAL FIELD

The present invention relates to a high-water pressure waterproof speaker.

BACKGROUND

A mobile device is fitted with a microspeaker to play the user notification sounds or audio content. More and more mobile devices are equipped with an everyday-life waterproofing feature to maximize the convenience of mobile devices. In line with this trend, a microspeaker fitted into a mobile device requires waterproofing.

FIG. 1 is a view showing a waterproof microspeaker according to the conventional art, the structure of which is disclosed in Korean Patent Registration No. 10-1889315. A main body of a vibrating membrane comprises a rigid top portion 11, a silicone rubber membrane 12, and a plastic support 13 attached to an edge of the silicone rubber membrane 12. The silicone rubber membrane 12 comprises a planar attaching portion 12*a* positioned at the center, a connecting portion 12*b* positioned at the edge and injection-molded and attached to the plastic support 13, and a bent ring portion 12*c* positioned between the attaching portion 12*a* and the connecting portion 12*b*. A protrusion or a concaved bent ring portion 12*c* is provided outside of the top portion 11, on the silicone rubber membrane 12. The distance between an outer edge of the top portion 11 and an inner edge of the bent ring portion 12*c* ranges between 0.02 mm and 0.2 mm, and an adhesive is applied to the gap between the top portion 11 and the bent ring portion 12*c*.

In the conventional art, the shape of a diaphragm (silicone rubber membrane) is molded, and a frame or the diaphragm is then attached with the application of glue. Thus, the amount of glue applied, the application position, and the bonding pressure affect the rate of waterproofing failure. Another disadvantage is that the rate of waterproofing failure is affected by how well waterproof tape is kept free from foreign materials and by the amount of compression, because audio components are assembled to an electronic device using the waterproof tape.

SUMMARY

An object of the present invention is to provide a waterproof speaker with a waterproof rating of 8 or more, that is capable of providing a waterproof function at a high water pressure.

According to an aspect of the present invention for achieving the above object, there is provided a high-water pressure waterproof speaker having a frame and a vibrating portion within the frame, the speaker comprising: the frame with a flange portion whose sidewall and upper edge extend outward; a diaphragm mounted within the frame; and a waterproof ring placed on a sidewall of the frame and configured to protrude further outward than the flange portion of the frame.

In some embodiments, the frame may be made from either steel material or injection-molding material.

In some embodiments, the diaphragm may comprise: a center portion positioned at the center; a ring-shaped dome portion formed around the center portion and protruding upward or downward; and a seating portion formed outside of the dome portion and seated on the frame.

In some embodiments, the seating portion may comprise: a first seating portion seated on an inner surface of the sidewall of the frame; and a second seating portion seated on an upper surface of the flange portion of the frame.

In some embodiments, the waterproof ring may be formed by injection-molding a liquid silicone rubber or by CIPG (cured-in-place gasket).

In some embodiments, an adhesive which has an adhesive force by means of heat and pressure may be applied to the flange portion of the frame, and the diaphragm and the frame may be bonded together by means of heat and pressure.

Since the high-water pressure waterproof speaker provided in the present invention is assembled to an electronic device by means of the waterproof ring placed outside of the frame, it has advantages such as being easy to prevent foreign material intrusion and eliminating any possibility of waterproofing failure depending on the amount of compression of waterproof tape, as compared to a conventional structure using waterproof tape.

Another advantage of the high-water pressure waterproof speaker provided in the present invention is that the frame and the diaphragm are bonded with heat and pressure, rather than being attached with the application of glue, which allows the frame and the diaphragm to be uniformly bonded, thereby reducing waterproofing failure.

Those skilled in the art will recognize additional features and advantages upon reading the following detailed description, and upon viewing the accompanying drawings.

DETAILED DESCRIPTION

Hereinafter, the present invention will be described in more details with reference to the drawings.

Figure 1:
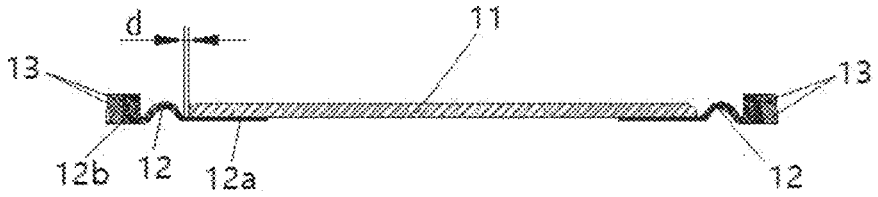
FIG. 1 is a view showing a waterproof microspeaker according to the conventional art.
Figure 2:
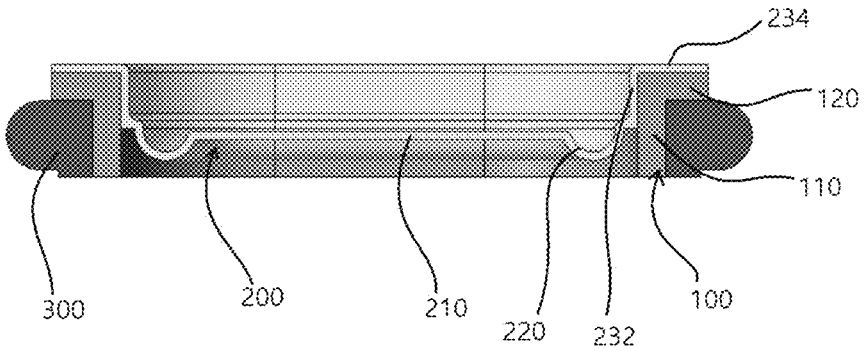
FIG. 2 is a view showing a high-water pressure waterproof microspeaker according to an exemplary embodiment of the present invention.

FIG. 2 is a view showing a high-water pressure waterproof microspeaker according to an exemplary embodiment of the present invention.

A high-water pressure waterproof microspeaker according to an exemplary embodiment of the present invention comprises a frame 100 and a vibrating portion within the frame 100, and the vibrating portion comprises a diaphragm 200 and a vibrating member that vibrates the diaphragm 200. The vibrating member may be a voice coil (not shown) and a magnetic circuit (not shown) which are generally used, or may be a piezoelectric element attached to the diaphragm 200.

The frame 100 comprises a sidewall 110 and a flange portion 120 extending outward from the upper edge of the sidewall 110. The aforementioned vibrating portion is placed within a space defined by the sidewall 110. The frame 100 may be made of either steel material or injection-molding material.

The diaphragm 200 comprises a center portion 210 positioned at the center, a ring-shaped dome portion 220 formed around the center portion 210 and protruding upward or downward, and a seating portion 232 and 234 formed outside of the dome portion 220 and seated on the frame 100.

The seating portion 232 and 234 comprises a first seating portion 232 seated on an inner surface of the sidewall 110 of the frame 100 and a second seating portion 234 seated on an upper surface of the flange portion 120 of the frame 100. An adhesive which has an adhesive force by means of heat and pressure is applied to the flange portion 120 of the frame 100. In the assembling process, the diaphragm 200 may be mounted on the frame 100, and then the flange portion 120 of the frame 100 and the second seating portion 234 of the diaphragm 200 may be bonded together by the application of heat and pressure.

The diaphragm 200 may be made of an elastomer material with elasticity, which, therefore, may return to its original configuration even if it is deformed by high water pressure applied from the outside.

Meanwhile, a waterproof ring 300 configured to protrude further outward than the flange portion 120 of the frame 100 is placed on an outer surface of the sidewall 110 of the frame 100.

The waterproof ring 300 is formed by injection-molding a liquid silicone rubber or by CI PG (cured-in-place gasket).

Figure 3:
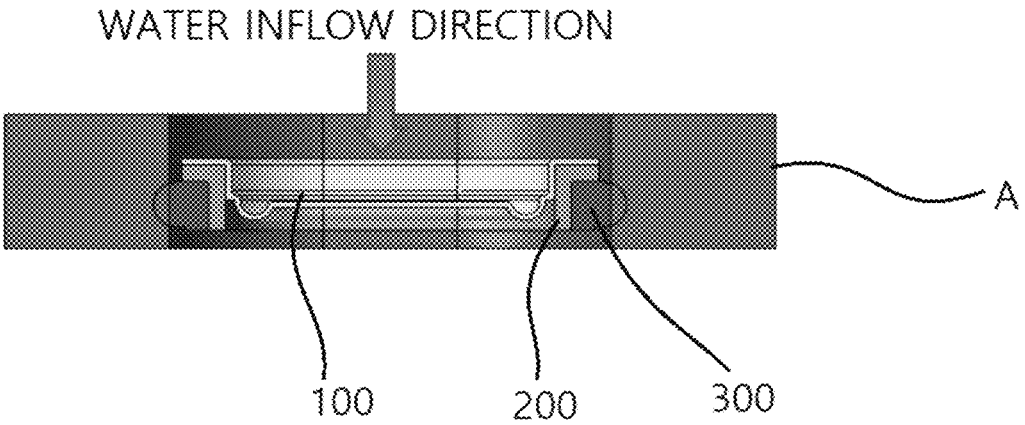
FIG. 3 is a view showing how a high-water pressure waterproof microspeaker according to an exemplary embodiment of the present invention is fitted into a device.

FIG. 3 is a view showing how a high-water pressure waterproof microspeaker according to an exemplary embodiment of the present invention is fitted into a device.

The waterproof ring 300 provides water tightness when fitted to a device A, because the waterproof ring 300 is made of a material with elasticity such as liquid silicone rubber and also the waterproof ring 300 is compressed when assembled thanks to its outer rim being larger than a microspeaker installation space in the device A. Accordingly, when water enters from above as shown in the figure, the watertight seal between the diaphragm 200 and the frame 100 and the watertight seal between the waterproof ring 300 and the device A are maintained, thereby ensuring waterproofing.

Since the high-water pressure waterproof speaker provided in the present invention is compressed when assembled to the electronic device A by means of the waterproof ring 300 placed outside of the frame 100, it has advantages such as being easy to prevent foreign materials from entering and eliminating any possibility of waterproofing failure depending on the amount of compression of waterproof tape, as compared to a conventional structure using waterproof tape.

Another advantage of the high-water pressure waterproof speaker provided in the present invention is that the frame 100 and the diaphragm 200 are bonded with heat and pressure, rather than being attached with the application of glue, which allows the frame 100 and the diaphragm 200 to be uniformly bonded, thereby reducing waterproofing failure.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A high-water pressure waterproof microspeaker configured to be assembled in a microspeaker installation space of a mobile device and comprising a vibrating portion within a frame, wherein the vibrating portion includes a diaphragm and a vibrating member that vibrates the diaphragm, the high-water pressure waterproof microspeaker further comprising:

the frame comprising a sidewall and a flange portion extending outward from an upper edge of the sidewall;

the diaphragm mounted on an upper surface of the flange portion of the frame; and a waterproof ring placed on an outer surface of the sidewall of the frame and below the flange portion and configured to protrude further outward than the flange portion of the frame so that an outer rim of the waterproof ring is larger than the microspeaker installation space of the mobile device, wherein when the microspeaker is assembled in the microspeaker installation space of the mobile device, the waterproof ring is compressed in the microspeaker installation space.

2. The high-water pressure waterproof microspeaker of claim 1, wherein the frame is made from either steel material or injection-molding material.

3. The high-water pressure waterproof microspeaker of claim 1, wherein the diaphragm comprises:

a center portion positioned at a center of the diaphragm;

a ring-shaped dome portion formed around the center portion and protruding upward or downward; and a seating portion formed outside of the ring-shaped dome portion and seated on the frame.

4. The high-water pressure waterproof microspeaker of claim 3, wherein the seating portion comprises:

a first seating portion seated on an inner surface of the sidewall of the frame; and a second seating portion seated on an upper surface of the flange portion of the frame.

5. The high-water pressure waterproof microspeaker of claim 1, wherein the waterproof ring comprises an injection-molded liquid silicone rubber.

6. The high-water pressure waterproof microspeaker of claim 1, wherein the waterproof ring is a cured-in-place gasket.

7. The high-water pressure waterproof microspeaker of claim 1, further comprising an adhesive applied to the flange portion of the frame, wherein the adhesive has an adhesive force by means of heat and pressure, and wherein the diaphragm and the flange portion of the frame are bonded together by means of heat and pressure.

* * * * *